US006234339B1

(12) United States Patent
Thomas

(10) Patent No.: US 6,234,339 B1
(45) Date of Patent: May 22, 2001

(54) TRASH CAN WITH LINER DISPENSER

(76) Inventor: Tronown V. Thomas, 6534 Richwood, Houston, TX (US) 77087

( * ) Notice: Subject to any disclaimer, the term of this patent is extended or adjusted under 35 U.S.C. 154(b) by 0 days.

(21) Appl. No.: 09/262,244

(22) Filed: Mar. 4, 1999

(51) Int. Cl.[7] ..... B65F 1/06
(52) U.S. Cl. ..... 220/495.07; 220/908.1
(58) Field of Search ..... 220/495.06, 495.07, 220/229, 908.1, 908

(56) References Cited

U.S. PATENT DOCUMENTS 2,793,373 * 5/1957 Ewing ..... 220/229 X
3,481,112 * 12/1969 Bourgeois ..... 220/495.07 X
4,577,778 * 3/1986 Kim ..... 220/495.07
4,955,497 * 9/1990 Winden et al. ..... 220/908 X
4,955,505 * 9/1990 Battaglia ..... 220/495.07
4,961,514 * 10/1990 Palmer ..... 220/908 X
5,165,564 * 11/1992 Prout et al. ..... 220/229 X
5,295,607 * 3/1994 Chang ..... 220/495.07
5,322,179 * 6/1994 Ting ..... 220/495.07
5,458,259 * 10/1995 Falk ..... 220/495.07 X
5,503,292 * 4/1996 Cuccharia ..... 220/495.07
5,671,847 * 9/1997 Pedersen et al. ..... 220/495.07 X

* cited by examiner

*Primary Examiner*—Steven Pollard

(57) ABSTRACT

A new trash can with liner dispenser for storing trash can liners therein. The inventive device includes a base with the top of the base having an opening therethrough with a plurality of slits outwardly radiating from the periphery of the opening. The perimeter side of the base has an annular lip extending therearound which defines a shoulder. The open lower end of a side wall is rested on shoulder of the base. The side wall has an elongate cutout extending through the inner and outer surfaces of the side wall. A door substantially closes the cutout of the side wall, the door is hingedly coupled to the side wall.

8 Claims, 2 Drawing Sheets

TRASH CAN WITH LINER DISPENSER

BACKGROUND OF THE INVENTION

1. Field of the Invention

The present invention relates to trash cans and more particularly pertains to a new trash can with liner dispenser for storing trash can liners therein.

2. Description of the Prior Art

The use of trash cans is known in the prior art. More specifically, trash cans heretofore devised and utilized are known to consist basically of familiar, expected and obvious structural configurations, notwithstanding the myriad of designs encompassed by the crowded prior art which have been developed for the fulfillment of countless objectives and requirements.

Known prior art trash cans include U.S. Pat. No. 5,405,041; U.S. Pat. No. 3,300,082; U.S. Pat. No. 4,364,490; U.S. Pat. No. 4,850,507; U.S. Pat. No. 4,319,694; and U.S. Pat. No. 2,722,993.

While these devices fulfill their respective, particular objectives and requirements, the aforementioned patents do not disclose a new trash can with liner dispenser. The inventive device includes a base with the top of the base having an opening therethrough with a plurality of slits outwardly radiating from the periphery of the opening. The perimeter side of the base has an annular lip extending therearound which defines a shoulder. The open lower end of a side wall is rested on shoulder of the base. The side wall has an elongate cutout extending through the inner and outer surfaces of the side wall. A door substantially closes the cutout of the side wall, the door is hingedly coupled to the side wall.

In these respects, the trash can with liner dispenser according to the present invention substantially departs from the conventional concepts and designs of the prior art, and in so doing provides an apparatus primarily developed for the purpose of storing trash can liners therein.

SUMMARY OF THE INVENTION

In view of the foregoing disadvantages inherent in the known types of trash cans now present in the prior art, the present invention provides a new trash can with liner dispenser construction wherein the same can be utilized for storing trash can liners therein.

The general purpose of the present invention, which will be described subsequently in greater detail, is to provide a new trash can with liner dispenser apparatus and method which has many of the advantages of the trash cans mentioned heretofore and many novel features that result in a new trash can with liner dispenser which is not anticipated, rendered obvious, suggested, or even implied by any of the prior art trash cans, either alone or in any combination thereof.

To attain this, the present invention generally comprises a base with the top of the base having an opening therethrough with a plurality of slits outwardly radiating from the periphery of the opening. The perimeter side of the base has an annular lip extending therearound which defines a shoulder. The open lower end of a side wall is rested on shoulder of the base. The side wall has an elongate cutout extending through the inner and outer surfaces of the side wall. A door substantially closes the cutout of the side wall, the door is hingedly coupled to the side wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trash can with liner dispenser apparatus and method which has many of the advantages of the trash cans mentioned heretofore and many novel features that result in a new trash can with liner dispenser which is not anticipated, rendered obvious, suggested, or even implied by any of the prior art trash cans, either alone or in any combination thereof.

It is another object of the present invention to provide a new trash can with liner dispenser which may be easily and efficiently manufactured and marketed.

It is a further object of the present invention to provide a new trash can with liner dispenser which is of a durable and reliable construction.

An even further object of the present invention is to provide a new trash can with liner dispenser which is susceptible of a low cost of manufacture with regard to both materials and labor, and which accordingly is then susceptible of low prices of sale to the consuming public, thereby making such trash can with liner dispenser economically available to the buying public.

Still yet another object of the present invention is to provide a new trash can with liner dispenser which provides in the apparatuses and methods of the prior art some of the advantages thereof, while simultaneously overcoming some of the disadvantages normally associated therewith.

Still another object of the present invention is to provide a new trash can with liner dispenser for storing trash can liners therein.

Yet another object of the present invention is to provide a new trash can with liner dispenser which includes a base with the top of the base having an opening therethrough with a plurality of slits outwardly radiating from the periphery of the opening. The perimeter side of the base has an annular lip extending therearound which defines a shoulder. The open lower end of a side wall is rested on shoulder of the base. The side wall has an elongate cutout extending through the inner and outer surfaces of the side wall. A door substantially closes the cutout of the side wall, the door is hingedly coupled to the side wall.

Still yet another object of the present invention is to provide a new trash can with liner dispenser that makes it easy to remove a filled trash bag from a trash can.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
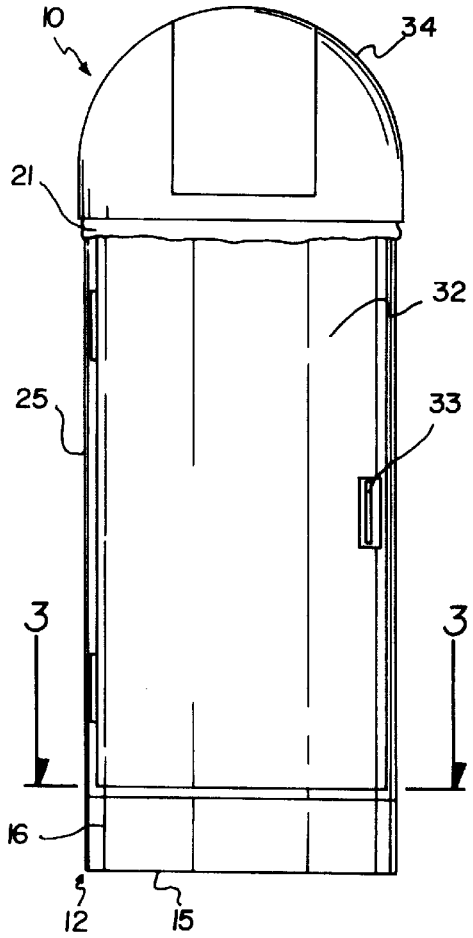
FIG. 1 is a schematic side view of a new trash can with liner dispenser according to the present invention.

With reference now to the drawings, and in particular to FIGS. 1 through 4 thereof, a new trash can with liner dispenser embodying the principles and concepts of the present invention and generally designated by the reference numeral 10 will be described.

As best illustrated in FIGS. 1 through 4, the trash can with liner dispenser 10 generally comprises a base 12 with the top 14 of the base 12 having an opening 17 therethrough with a plurality of slits 18 outwardly radiating from the periphery of the opening 17. The perimeter side 16 of the base 12 has an annular lip 22 extending therearound which defines a shoulder 23. The open lower end 29 of a side wall 25 is rested on shoulder 23 of the base 12. The side wall 25 has an elongate cutout 31 extending through the inner and outer surfaces 26,27 of the side wall 25. A door 32 substantially closes the cutout 31 of the side wall 25, the door 32 is hingedly coupled to the side wall 25.

Figure 3:
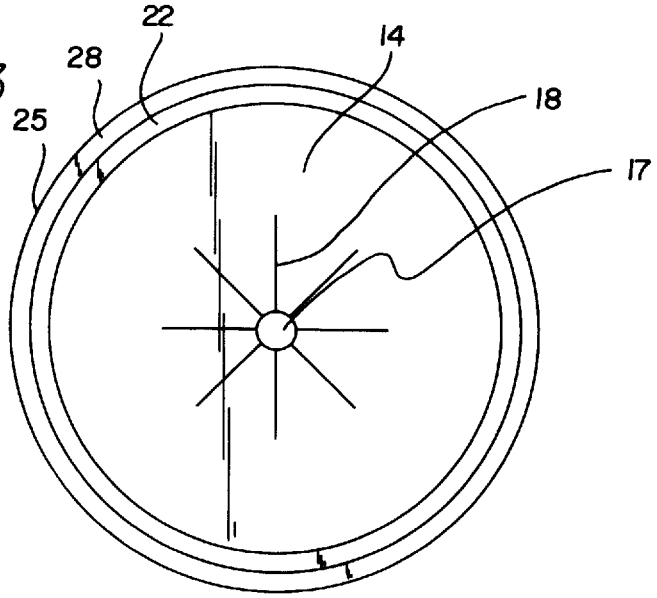
FIG. 3 is a schematic top side view of the present invention.
Figure 4:
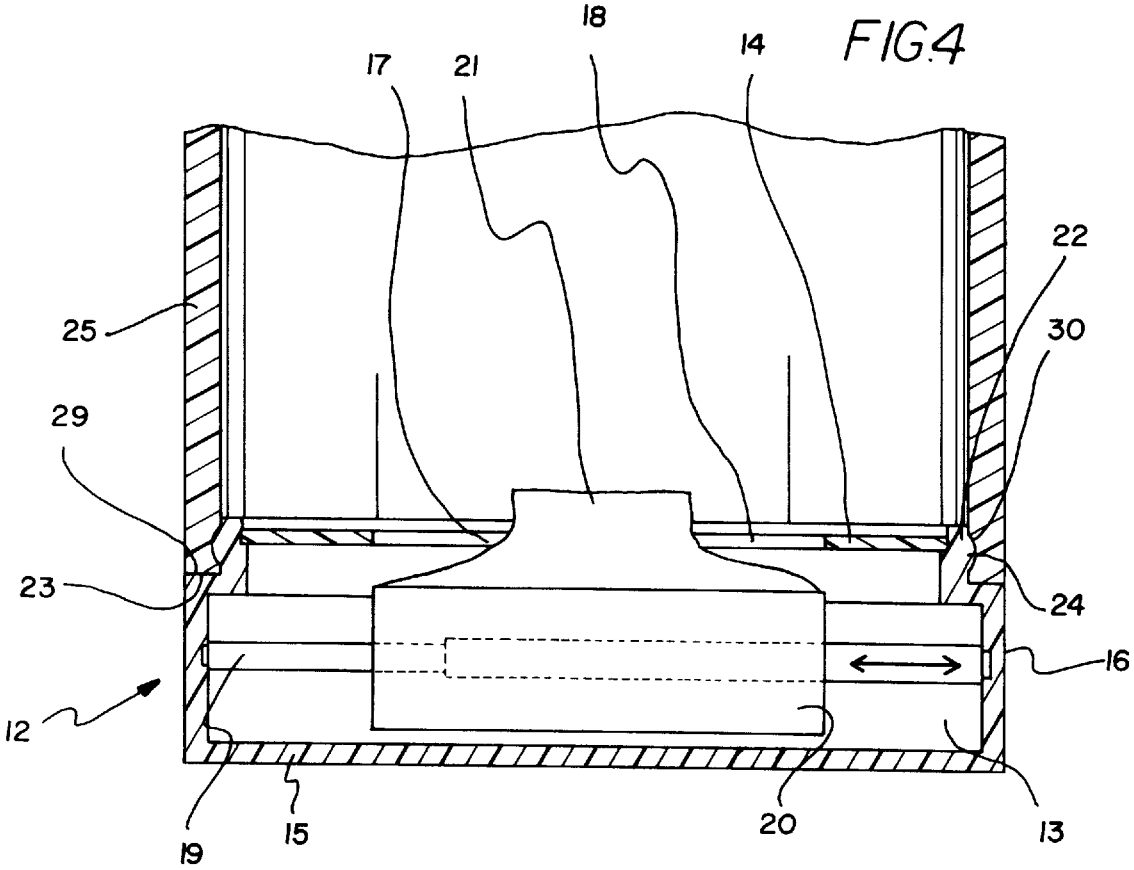
FIG. 4 is a schematic sectional view of the present invention taken from line 4—4 of FIG. 2.

In closer detail, the base 12 an interior space 13, a top 14, a bottom 15, and a perimeter side 16 between the top 14 and bottom 15 the base 12. The base 12 is preferably generally disk-shaped and has a diameter with the top 14 and bottom 15 of the base 12 each being generally circular and having a center. As illustrated in FIG. 3, the top 14 of the base 12 has an opening therethrough. The opening 17 of the top 14 of the base 12 has a generally cylindrical periphery and is preferably located at the center of the top 14 of the base 12. A plurality of slits 18 through the top of the base outwardly radiate from the periphery of the opening 17 of the top 14 of the base 12. With reference to FIG. 4, preferably the top 14 is separable from perimeter side 16 of base 12 to define an access opening into the interior space 13 of the base 12. An elongate roller 19 is disposed in the interior of the base 12. The roller 19 is preferably telescopic and has a pair of opposite ends which are biased away from each other by a spring. The ends of the roller 19 are mounted to the perimeter side 16 of the base 12 (by insertion into receiving holes in the perimeter side 16 of the base 12) to permit free rotation about the longitudinal axis of the roller 19. In the preferred embodiment, the roller 19 is diametrically extended between the perimeter side 16 of the base 12. The roller 19 is adapted for receiving a roll of trash bags 20 therearound. The opening 17 of the top 14 of the base 12 is adapted for extending a trash bag 21 therethrough from the interior space 13 of the base 12 while the slits are designed for allowing tearing of attached trash bags 21 on the roll of trash bags 20. The perimeter side 16 of the base 12 has an annular lip 22 extending therearound which is positioned adjacent the top 14 of the base 12. The lip 22 defines a shoulder 23. The lip 22 also has an annular ridge 24 outwardly extending therefrom.

The side wall 25 is preferably generally cylindrical and has inner and outer surfaces 26,27, an open upper end 28, an open lower end 29, and a diameter. The open lower end 29 of the side wall 25 is rested on shoulder 23 of the base 12 around the outer perimeter of the base 12. The inner surface 26 of the side wall 25 has an annular groove 30 therearound which is positioned adjacent the open lower end 29 of the side wall 2. The ridge 24 of the lip 22 of the base 12 is inserted into the groove 30 of the inner surface 26 of the side wall 25 such that the side wall 25 is held to the base 12.

The side wall 25 also has an elongate cutout 31 extending through the inner and outer surfaces 26,27 of the side wall 25. The cutout 31 has a generally rectangular periphery having a length and a width. The length of the cutout 31 is extended from the open upper end 28 of the side wall 25 towards the open lower end 29 of the side wall 25. The width of the cutout 31 is extended along the circumference of the side wall 25 such that the cutout 31 defines a generally semicircular arc along the circumference of the side wall 25. Preferably, a door 32 substantially closes the cutout 31 of the side wall 25. The door 32 is hingedly coupled to the side wall 25 and ideally includes a latch 33 to permit secure closing of the cutout 31 by the door 32.

Figure 2:
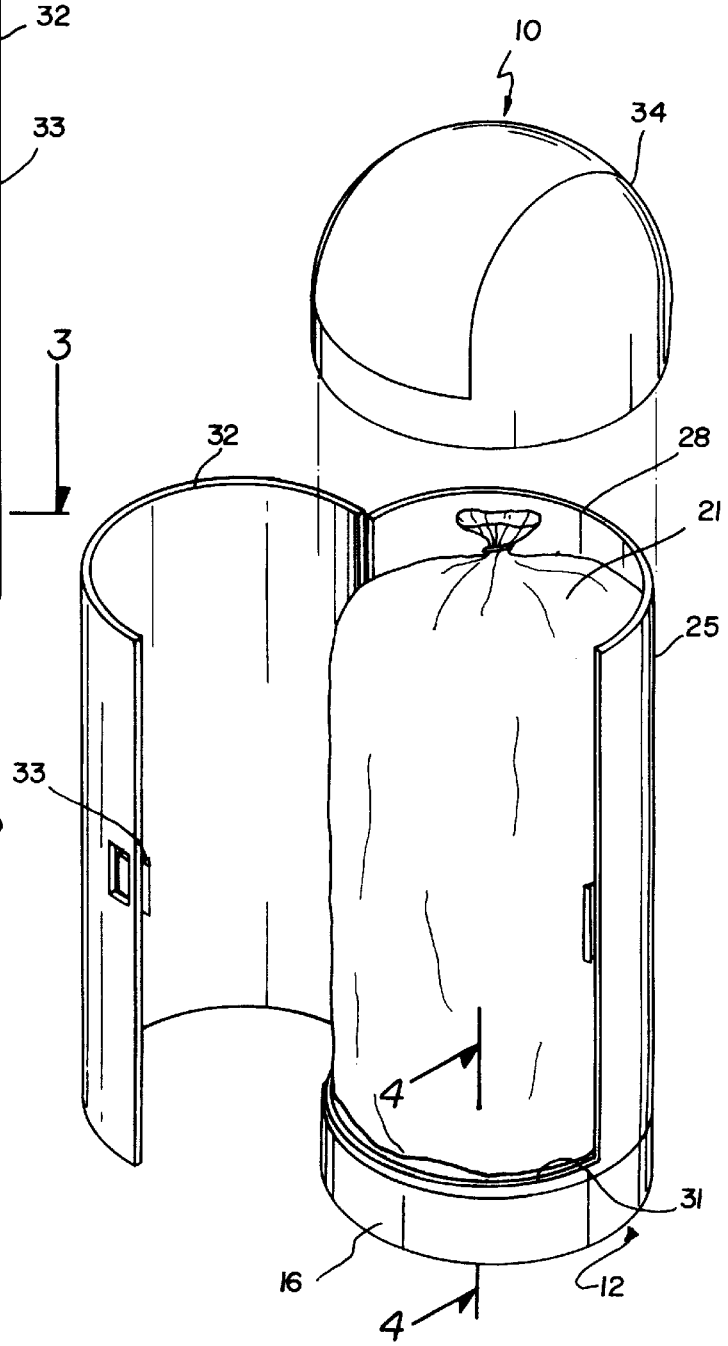
FIG. 2 is a schematic perspective view of the present invention.

With reference to FIGS. 1 and 2, preferably a lid 34 is also provided. The lid is preferably generally hemispherical and substantially covers the open upper end 28 of the side wall 25. The lid has an top opening and has a pivotally mounted swing panel covering the top opening.

In an ideal illustrative embodiment, the diameter of the base 12 and side wall 25 are between about 16 and 20 inches. Ideally, the length of the base 12 between the top 14 and bottom 15 of the base 12 is less than about 6 inches, while the length of the side wall 25 is less than about 24 inches. In this embodiment, the height of the lid is preferably less than about 6 inches.

In use, a trash bag or liner is pulled through the opening of the top of the base and used to line the inner surface of the side wall. The trash bag may be separated from the other bags with the aid of the slits for tearing any perforations between the adjacent trash bags on the roll. To remove a filled trash bag from the container, the bag may be passed through the cutout so that a user does not have to lift a heavy bag too high to get it out of the container.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A container, comprising:

a base having an interior space, a top, a bottom, and a perimeter side between said top and bottom of said base, said top and bottom of said base each having a center;

said top of said base having an opening therethrough, said opening of said top of said base having a periphery, said top of said base having a plurality of slits therethrough outwardly radiating from said periphery of said opening of said top of said base;

an elongate roller being disposed in said interior of said base, said roller having a pair of opposite ends, said ends of said roller being mounted to said perimeter side of said base to permit free rotation;

said perimeter side of said base having an annular lip extending therearound, said lip being positioned adjacent said top of said base, said lip defining a shoulder;

a side wall having inner and outer surfaces, an open upper end, and an open lower end;

said open lower end of said side wall being rested on shoulder of said base;

said side wall having an elongate cutout extending through said inner and outer surfaces of said side wall, said cutout having a periphery having a length and a width, said length of said cutout being extended from said open upper end of said side wall towards said open lower end of said side wall; and a door substantially closing said cutout of said side wall, said door being hingedly coupled to said side wall.

2. The container of claim 1, wherein said base is generally disk-shaped, said top and bottom of said base each being generally circular, and a side wall being generally cylindrical.

3. The container of claim 1, wherein said opening of said top of said base is located at said center of said top of said base.

4. The container of claim 1, wherein said top is separable from perimeter side of base to define an access opening into said interior space of said base.

5. The container of claim 1, wherein said roller is telescopic, said ends of said roller being biased away from each other.

6. The container of claim 1, wherein said lip has an annular ridge outwardly extending therefrom, wherein said inner surface of said side wall has an annular groove therearound, said groove of said inner surface of said side wall being positioned adjacent said open lower end of said side wall, said ridge of said lip of said base being inserted into said groove of said inner surface of said side wall.

7. The container of claim 1, further comprising a lid substantially covering said open upper end of said side wall.

8. A container, comprising:

a base being generally disk-shaped and having an interior space, a top, a bottom, and a perimeter side between said top and bottom said base, said base having a diameter, said top and bottom of said base each being generally circular and having a center;

said top of said base having an opening therethrough, said opening of said top of said base having a generally cylindrical periphery, said opening of said top of said base being located at said center of said top of said base, said top of said base having a plurality of slits therethrough outwardly radiating from said periphery of said opening of said top of said base;

said top being separable from perimeter side of base to define an access opening into said interior space of said base;

an elongate roller being disposed in said interior of said base, said roller being telescopic and having a pair of opposite ends, said ends of said roller being biased away from each other, said ends of said roller being mounted to said perimeter side of said base to permit free rotation, said roller being diametrically extended between said perimeter side of said base;

said perimeter side of said base having an annular lip extending therearound, said lip being positioned adjacent said top of said base, said lip defining a shoulder, said lip having an annular ridge outwardly extending therefrom;

a side wall being generally cylindrical and having inner and outer surfaces, an open upper end, an open lower end, and a diameter;

said open lower end of said side wall being rested on shoulder of said base;

said inner surface of said side wall having an annular groove therearound, said groove of said inner surface of said side wall being positioned adjacent said open lower end of said side wall, said ridge of said lip of said base being inserted into said groove of said inner surface of said side wall;

said side wall having an elongate cutout extending through said inner and outer surfaces of said side wall, said cutout having a generally rectangular periphery having a length and a width, said length of said cutout being extended from said open upper end of said side wall towards said open lower end of said side wall, said width of said cutout being extended along the circumference of said side wall such that said cutout defines a generally semicircular arc along the circumference of said side wall;

a door substantially closing said cutout of said side wall, said door being hingedly coupled to said side wall; and a lid being generally hemispherical and substantially covering said open upper end of said side wall.

* * * * *